United States Patent [19]

Carson

[11] Patent Number: 4,505,758

[45] Date of Patent: Mar. 19, 1985

[54] HEAT EXCHANGER DEPOSIT REMOVAL

[75] Inventor: Don B. Carson, Mt. Prospect, Ill.

[73] Assignee: UOP Inc., Des Plaines, Ill.

[21] Appl. No.: 502,903

[22] Filed: Jun. 10, 1983

[51] Int. Cl.[3] ..... B08B 7/04; B08B 9/02

[52] U.S. Cl. ..... 134/1; 134/5; 134/19; 134/22.11; 165/95

[58] Field of Search ..... 134/1, 5, 19, 22.11; 165/95

[56] References Cited

U.S. PATENT DOCUMENTS

| | | | |
|---|---|---|---|
| 1,809,185 | 6/1931 | Sydnor . | |
| 2,452,367 | 10/1948 | Gangloff | 134/5 X |
| 3,354,292 | 11/1967 | Kahn | 219/301 |
| 3,377,463 | 4/1968 | Rolfes | 219/300 |
| 3,983,360 | 9/1976 | Offermann | 219/301 |
| 4,152,577 | 5/1979 | Leavines | 219/301 |
| 4,175,614 | 11/1979 | Huggins | 134/5 X |
| 4,243,381 | 1/1981 | Genevois et al. | 134/5 X |

*Primary Examiner*—Marc L. Caroff

*Attorney, Agent, or Firm*—James R. Hoatson, Jr.; Richard J. Cordovano; William H. Page, II

[57] ABSTRACT

Heat exchanger tubes are cleaned, while the heat exchanger is operated to cool a liquid passing through the tubes, by applying an electric current to a portion of the tubes for brief time periods to heat such tubes to a temperature sufficient to melt or soften deposits therein, while simultaneously continuing to pass liquid therethrough.

1 Claim, 2 Drawing Figures

HEAT EXCHANGER DEPOSIT REMOVAL

BACKGROUND OF THE INVENTION

This invention relates to cleaning of heat exchange apparatus. More specifically, it relates to the removal of solids which accumulate on relatively cold surfaces of a heat exchanger, or cooler, in which a fluid stream is cooled by a gas stream.

In the cooling of fluids consisting of several components, one (or more) of which has a relatively high melting point, it is common that the high melting point component accumulates on relatively cold surfaces of the cooler. Deposits may form because the local film temperature is low or solid or semi-solid particles in the fluid stream may stick to surfaces upon which they impinge. The problem is magnified at surfaces where the fluid velocity is low. These accumulations or deposits reduce the amount of heat transferred from the fluid to the cooling media when they form directly on the heat transfer surface and increase the pressure drop across the cooler, regardless of whether they form on active transfer surface or elsewhere in the flow paths of the cooler. In order to remove deposits, either mechanically or by adding steam to the apparatus, the cooler must be taken out of service. Since it is seldom that spare heat exchangers are installed, the necessity for cleaning often requires shutting down a complete production unit.

Certain operations in a petroleum refinery are particularly susceptible to solids depositing in coolers. Among these operations are hydrocracking of distillates and heavy gas oils. The deposits may comprise paraffin waxes and condensed ring aromatics. Another example of a problem area in a refinery is deasphalting, where asphalt droplets entrained in a process stream solidify and accumulate in the cooler when the stream is cooled. Refinery units normally operate on a continuous basis, shutting down only once a year for maintenance and repair. To avoid a shut-down, adverse operating conditions may be accepted as the lesser of the two evils. For example, a higher temperature stream from a cooler will have undesirable effects on a vapor-liquid separator and a compressor, which are commonly located downstream in a refinery. It is usually desirable to run both of these pieces of equipment at as low a temperature as possible, in order to increase yield of product and decrease maintenance expense.

INFORMATION DISCLOSURE

Removal of deposits in cooling apparatus by application of heat while the cooling apparatus is in operation was unknown to me before I conceived this invention. However, heating of many types of apparatus to prevent freezing of liquid contained therein is quite common. Certain kinds of cooling apparatus utilize tubes to contain the cooled liquid. Consideration of flow in the tubes of such apparatus brings to mind liquids flowing in heated pipelines. An early reference to this can be found in U.S. Pat. No. 1,809,185 (Sydnor). Apparatus for heating of pipes abounds; examples are in U.S. Pat. Nos. 3,377,463 (Rolfes), 3,354,292 (Kahn), and 4,152,577 (Leavines). In all of these examples, heating apparatus is attached to the outside of the pipelines. It is readily seen that this heating apparatus cannot be used on tubular cooling apparatus, where the tubes are surrounded by the cooling medium. Further, this heating apparatus is provided for the purpose of maintaining temperature and is not capable of adding enough heat to significantly increase temperature. Another example of heating pipelines is in U.S. Pat. No. 3,983,360 (Offermann), which is believed exemplary of these patents dealing with skin effect heating. It is not uncommon to thaw frozen pipes by applying electric current to the pipelines themselves. However, heating of pipelines is quite different from cleaning of cooling apparatus, even tubular cooling apparatus, while it is in operation.

BRIEF SUMMARY OF THE INVENTION

It is an object of this invention to provide a method for removing deposits from, or cleaning, heat exchange apparatus used in cooling a fluid by means of gaseous cooling media. The deposits are formed when a component (or components) of the fluid having a high melting point contacts a relatively cold surface of the cooling apparatus and freezes or sticks to the surface. Removal is accomplished by passing electric current (alternating or direct) through portions of the cooling apparatus, one portion at a time, to melt or soften a portion of the deposits at the point where they adhere to the surfaces so that they will be swept away by the fluid stream. Since electric current is used, both fluid and gas must be electrically inactive, that is, non-conductors of and unaffected by the electric current.

It is also an object of this invention that the method be capable of use while the heat exchange apparatus is in use, so as not to interrupt the plant operation utilizing the heat exchange apparatus. This is accomplished by passing electric current through portions of the cooling apparatus in sequence, one portion at a time. Further, sufficient current is applied so that the time period required to clean each portion is relatively brief.

A further object of this invention is to provide a method which can easily be practiced for cleaning existing cooling apparatus, that is, one which does not require consideration during design and installation, but can be easily retrofitted. Other objects will become apparent upon consideration of the whole specification.

DETAILED DESCRIPTION OF THE INVENTION

Figure 1:
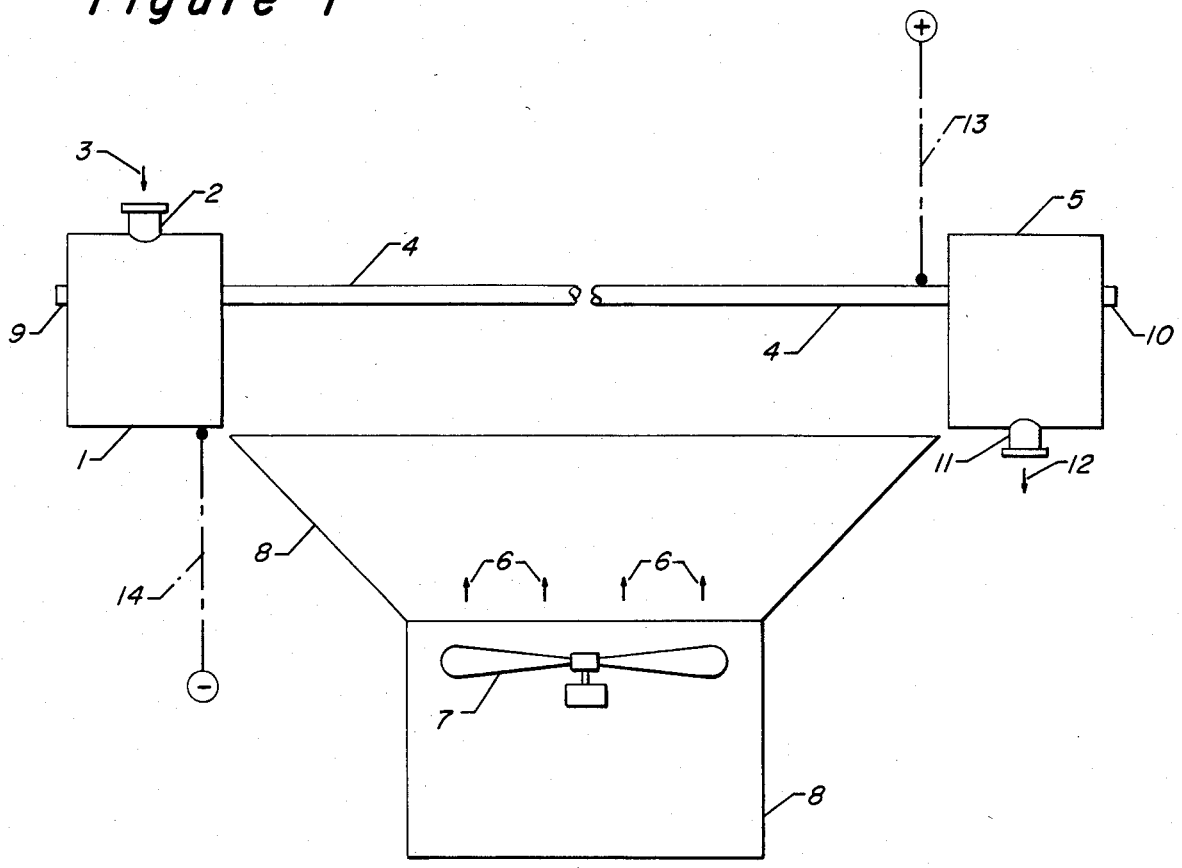
FIG. 1 is a schematic representation (side view) of a particular type of fluid cooling apparatus, commonly called a fin-fan exchanger, in which fluid is passed through a plurality of tubes over which atmospheric air is passed by means of a fan or fans. Only one tube is shown.

The practice of the invention will be explained by initial reference to its use in conjunction with a commonly used type of cooling apparatus, which finds much application in the refining of crude oil and subsequent processing. This example is not intended to limit the scope of the invention in any way. Referring to FIG. 1, inlet header box 1 receives fluid to be cooled by means of a pipeline (not shown) connected to inlet nozzle 2, as represented by arrow 3. Usually, there will be multiple inlet nozzles spaced along the header box (not shown). Fluid flows out of inlet header box 1 by means of a plurality of tubes, only one of which is depicted, denoted 4, in FIG. 1. Fluid flowing through tube 4 and the other tubes collects in outlet header box 5. Atmospheric air is blown over the tubes, as shown by arrows 6, by means of a fan (or fans), which is represented by the fan symbol denoted 7. Housing 8 encloses the air flow path so that air moved by the fan passes over the tubes. Cooled fluid flows out of the fin-fan cooler as shown by arrow 12, through outlet nozzle 11. Usually, there will be multiple outlet nozzles (not shown). The tubes are usually of the type having external fins to increase the transfer of heat from the fluid inside the tubes to the air. A clean-out plug for each tube is often provided in the locations denoted by 9 and 10. Removal of the plugs provides access to the ends of the tube so that a cleaning element can be inserted into the tube and passed through it. In a single pass fin-fan exchanger, a straight rod can be passed through the entire tube.

In this type of cooler, it is usually necessary to clean only the tubes and not the header boxes or nozzles. Electrical leads 13 and 14 will allow electric current to be passed through tube 4. Additional leads (not shown) are attached to the other tubes (not shown) in the same manner as lead 13. Lead 14 will suffice for all of the tubes, though it may be desirable to provide more than one lead (but fewer than the number of tubes). When current flows through tube 4, it will heat the inside surface of the tube sufficiently to melt or soften the portions of the deposits on the tube which are in direct contact with the tube, thus breaking the bond between deposit and tube and permitting the deposits to be flushed away by the moving fluid. Sufficient current is provided to quickly heat the tube to an effective temperature even though heat is rapidly removed by both the air and fluid streams. A limited time period will minimize waste of power in heating air and fluid and will minimize the amount of heat added to the fluid, since the object of the cooler is to cool the fluid, rather than to add heat to it. It can also be seen that electrical leads can be selectively positioned to clean only those particular portions of a cooler which are most susceptible to deposit formation.

The portion of the cooler that will be cleaned at one time, that is, the number of tubes to which current will be applied at the same time, depends on a variety of factors. For example, the more tubes heated at the same time, the more electrical capacity is required, electrical capacity which is unused much of the time. Unit electrical resistance of the particular material of construction is important in determining the amount of heat generated per square foot of tube. Heat flux at the tubes determines the amount of heating of the fluid. Required electrical capacity depends on the tube wall temperature which must be attained to melt deposits. These design considerations become clear to one skilled in the art and the design is easily resolved once a specific installation is considered. Though the voltage required must be determined by reference to the variables of each particular situation, it will normally be relatively low, less than 30 to 40 volts, and will seldom exceed 100 volts. The time period for which current flows through each portion of a cooler will often be much less than one minute, preferably no more than that amount, and certainly will be less than five minutes.

Figure 2:
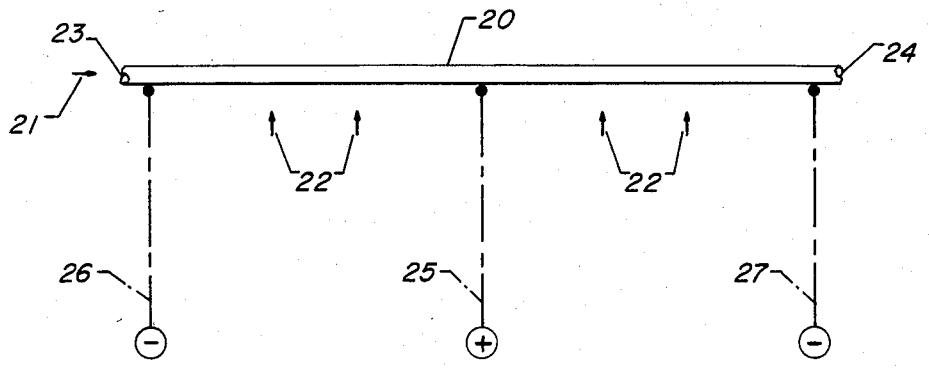
FIG. 2 is a representation of a segment of a single tube in an exchanger such as that of FIG. 1. Electrical leads for practice of the invention are shown.

To further illuminate the invention, a numerical example using a tubular cooler is presented. Referring to FIG. 2, consider a 40 ft. long tube segment 20 as having 10 gpm of material flowing through it as represented by arrow 21. The tube segment is carbon steel, one inch in diameter with a 12 gauge wall, and is finned. The flowing material is the liquid hydrocarbon product produced when a heavy gas oil is subjected to a hydrocracking process and it enters tube segment 20 at point 23 at a temperature of 300° F. Air at 80° F. is passed over the tube perpendicular to its longitudinal axis as indicated by arrows 22. Liquid leaving the tube at point 24 is at a temperature of 206° F.

The flowing stream contains a small amount of coronene, which is common in such streams and which tends to deposit on tube walls when the temperature falls below about 290° to 300° F. To clean tube segment 20, 8.5 volts will be applied by means of electrical leads 25, 26, and 27. 6900 Amperes will flow through lead 25 and 3450 amperes will flow through each section of the tube. Power is calculated by the familiar $I^2R$ relationship. It is calculated that current flow need be maintained for only 6 seconds in order to remove all coronene deposits. After 6 seconds, the temperature of liquid leaving tube segment 20 at point 24 will be 292° F. The tube wall temperature will be approximately 300° F. Thus, the calculations show that it is feasible to heat the tube segment sufficiently to remove deposits during operation and with a relatively small amount of power.

Consider the influence of cleaning a tube during operation on the performance of cooling apparatus. If tube segment 20 of the above example is one tube of 200 tubes in a fin-fan cooler, it can be seen by inspection of the numbers that the temperature of the whole stream of cooled liquid will increase by less than 0.5° F. This increase will be effective only for about 6 seconds. Several tubes can easily be cleaned at one time without an unreasonably large outlet temperature increase. Even if ten tubes were cleaned at one time, the 6-second temperature increase would be less than 5° F. The allowable temperature increase of the cooled fluid in any cooling apparatus due to cleaning is highly dependent on the equipment or processing steps downstream of the cooler. For example, if a cooled stream is flowing to a large storage tank, a relatively large temperature increase may be tolerable because the quantity of heated liquid is small in comparison with the quantity of cooler liquid in the tank. A stream temperature increase of 100° F. would be considered substantial in most cases, but that amount of increase for the relatively limited time period of one-half hour would likely have no impact where the stream is flowing to a large storage tank. If the temperature increase is 20° F., which is considered an insubstantial increase when the stream is flowing to a large storage tank, the increase could last for hours and still have no significant impact.

Practice of the invention can be totally manual or automated so that cleaning of a cooler takes place without human attention. In a manual installation, an operator would switch power from one exchanger portion, such as one tube or group of tubes, to another, maintaining an appropriate time interval for each portion of the cooler. In a more automated installation, an operator would initiate the cleaning sequence and then a timer would operate switches to transfer power from portion to portion at previously set intervals.

There are several areas where caution and careful design are required, as in all industrial installations. Referring to the example of FIG. 1, it is necessary to attach leads 13 and 14 to tube 4 in a secure manner using appropriate connecting means. It can be seen that the possibility of burning a hole in tube 4 exists, should the connection have high resistance or if there is a break in the conductor near the tube. Thermal expansion of the heated tube must be considered. A multi-pass U-tube configuration permits tubes to expand in a longitudinal direction, but in a fin-fan unit with straight tubes, the force developed must be considered, since it is possible to break the joint between the tube and the header box. Care must also be taken in design to prevent the possibility of electrical current passing through a human being. Note however, that the danger to personnel is minimized by use of low voltages in the practice of this invention.

The examples herein have dealt with tubular heat exchangers and, in particular, with fin-fan units because these are a common type in which solids accumulate. Of course, the invention can be practiced with other types of coolers, such as a plate and frame heat exchanger. One particular application of a plate-type cooler in which the invention may be quite useful is in an air separation plant. The use of the term "fluid" herein refers to vapors, condensed vapors, and mixtures thereof.

I claim as my invention:

1. In a method for cleaning indirect heat exchanger tubes while said tubes are in continuous use to cool a liquid emanating from a hydrocarbon reaction zone by passing said liquid through the tubes in indirect heat exchange relationship to a relatively cooler gaseous stream, wherein said hydrocarbon reaction zone liquid deposits particles on the inside of said heat exchanger tubes, the improvement which consists of intermittently applying for a short period of time an electric current to at least a portion of said heat exchanger tubes to heat said portion to a temperature sufficient to soften said deposited particles on the inside of the so heated tubes while simultaneously passing said hydrocarbon reaction zone liquid continuously therethrough to physically remove said softened deposits.

* * * * *